US005264118A

United States Patent [19]

Cymerman et al.

[11] Patent Number: 5,264,118

[45] Date of Patent: Nov. 23, 1993

[54] PIPELINE CONDITIONING PROCESS FOR MINED OIL-SAND

[75] Inventors: George J. Cymerman, Edmonton; Antony H. S. Leung, Sherwood Park; Waldemar B. Maciejewski, Edmonton, all of Canada

[73] Assignees: Alberta Energy Company, Ltd.; Canadian Occidental Petroleum Ltd.; Esso Resources Canada Limited, all of Calgary; Gulf Canada Resources Limited, Toronto; Her Majesty the Queen in right of the Province of Alberta, as represented by the Minister of Energy and Natural Resources, Edmonton; HBOG-Oil Sands Limited Partnership, Calgary; PanCanadian Petroleum Limited, Calgary; Petro-Canada Inc., Calgary, all of Canada

[21] Appl. No.: 812,920

[22] Filed: Dec. 26, 1991

Related U.S. Application Data

[63] Continuation-in-part of Ser. No. 440,926, Nov. 24, 1989, abandoned.

[51] Int. Cl.[5] ..... C10G 1/04

[52] U.S. Cl. ..... 208/390; 208/370; 208/391; 208/432; 208/433; 208/407

[58] Field of Search ..... 208/390, 432, 433, 391, 208/370, 407

[56] References Cited

U.S. PATENT DOCUMENTS

| | | | |
|---|---|---|---|
| 1,312,266 | 8/1919 | Navin | 208/390 |
| 2,767,138 | 1/1954 | Loeffler et al. | 208/47 |
| 3,527,692 | 2/1968 | Titus | 208/390 |
| 3,864,251 | 2/1975 | Cymbalisty | 208/391 |
| 3,925,189 | 12/1975 | Wicks, III | 208/432 |
| 4,116,809 | 9/1978 | Kizior | 208/432 |
| 4,120,777 | 10/1978 | Globus | 208/391 |
| 4,276,021 | 6/1981 | Karnofsky et al. | 208/391 |
| 4,309,269 | 1/1982 | Denker et al. | 208/432 |
| 4,383,914 | 5/1983 | Kizior | 208/390 |
| 4,396,498 | 8/1983 | Dente et al. | 208/391 |
| 4,425,227 | 1/1984 | Smith | 208/391 |
| 4,451,351 | 5/1984 | Porter | 208/433 |
| 4,457,827 | 7/1984 | Chung et al. | 208/390 |
| 4,459,200 | 7/1984 | Dente et al. | 208/390 |
| 4,512,872 | 4/1985 | Chung et al. | 208/390 |
| 4,533,459 | 8/1985 | Dente et al. | 208/391 |
| 4,545,892 | 10/1985 | Cymbalisty | 208/432 |
| 4,702,487 | 10/1987 | Stoian et al. | 208/390 |
| 4,776,949 | 10/1988 | Leung et al. | 208/390 |
| 4,822,481 | 4/1989 | Taylor | 208/390 |
| 4,875,998 | 10/1989 | Rendall | 208/390 |
| 5,118,408 | 6/1992 | Jansen et al. | 208/390 |

FOREIGN PATENT DOCUMENTS

| | | | |
|---|---|---|---|
| 918588 | 1/1969 | Canada | 208/390 |
| 952844 | 8/1974 | Canada | 208/390 |
| 1066643 | 11/1979 | Canada | 208/390 |
| 1094483 | 1/1981 | Canada | 208/391 |
| 0269231 | 6/1988 | European Pat. Off. | 208/391 |

OTHER PUBLICATIONS

Gerson et al., "Bitiment Extraction From Tar Sands with Microbial Surfactants", The Oil Sands of Canada-Venezuela Jun. 1977, vol. 17, pp. 705-710.

*Primary Examiner*—Helane Myers
*Attorney, Agent, or Firm*—Millen, White, Zelane & Branigan

[57] ABSTRACT

As-mined, naturally water-wet oil sand is mixed at the mine site with hot water and NaOH to produce a slurry containing entrained air. The slurry is pumped through a pipeline and is fed directly to a conventional gravity separation vessel. The pipeline is of sufficient length so that, in the course of being pumped therethrough, sufficient coalescence and aeration of bitumen occurs so that, when subsequently retained in the gravity separation vessel under quiescent conditions, a viable amount of the bitumen floats, forms froth, and is recovered.

9 Claims, 13 Drawing Sheets

PIPELINE CONDITIONING PROCESS FOR MINED OIL-SAND

CROSS-REFERENCE

This is a continuation-in-part of application Ser. No. 07/440,926 filed Nov. 24, 1989, now abandoned.

FIELD OF THE INVENTION

This invention relates to simultaneously transporting and conditioning oil sand in an aqueous slurry in a pipeline extending between a mine and an extraction plant. More particularly, it relates to a process comprising the steps of forming a slurry comprising oil sand, hot water, entrained air and (optionally) process aid (e.g. NaOH) at the mine site, pumping the resultant slurry through the pipeline, whereby contained bitumen flecks coalesce and are aerated, and feeding the slurry directly into a gravity separation vessel to recover the major portion of the bitumen as primary froth.

BACKGROUND OF THE INVENTION

The present invention is a modification of the conventional commercial system used to extract bitumen from mineable oil sand. In order to understand the manner in which the invention departs from this conventional system and to appreciate the discoveries on which the invention is based, it is first useful to describe the conventional system.

As previously stated, the invention has to do with oil sand, specifically the oil sand of the Athabasca deposit which exists in Northern Alberta. This oil sand comprises sand grains that are water-wet or individually coated with a thin sheath of water. The bitumen or oil is present as flecks located in the interstices between the wet grains.

At applicants' plant, the deposit is surface mined by first removing overburden and then using a dragline to excavate the oil sand and dump it to one side in the form of a windrow. A bucket wheel reclaimer transfers this windrowed oil sand on to the feed end of a conveyor belt train, which carries it to an extraction plant.

Applicant's operation involves mining about 300,000 tons of oil sand per day in this way. Four draglines are employed, each feeding a separate reclaimer and conveyor belt train.

Each such conveyor belt train comprises a plurality of separate endless conveyors placed end to end in series. The conveyors of one train typically can extend a length of 5 miles.

The conveyor system being utilized is characterized by a number of disadvantages, including:

- That each conveyor consumes a large amount of electric power. A 72 inch wide conveyor having a length of 3 miles requires several 1200 horsepower motors for operation;
- That the conveyor train has to turn corners, which is a difficult and expensive operation requiring use of a multiplicity of short straight conveyors at the turn;
- That the tacky bitumen causes some oil sand to adhere to and build up on the belt surface. This creates a dead load which is difficult to prevent and remove; and
- That the conveyors are subjected to heavy wear in this service, due to impacts by rocks in the oil sand and the erosive nature of the sand.

In summary, the conveyor systems used are a troublesome and expensive means for transferring the oil sand from the mine to the extraction plant.

It will also be noted that a conveyor system transports the whole oil sand to the plant, for the sole purpose of extracting the bitumen. The bitumen constitutes only about 6–15% by weight of the processable oil sand mass. Conveying all of the associated gangue material significantly reduces the economic attractiveness of the operation.

Once the oil sand arrives at assignees' extraction plant, it is fed into one of four extraction circuits, each of which begins with a tumbler. These tumblers are large, horizontal, rotating drums. In the drum, the oil sand is mixed with hot water and a small amount of process aid, normally sodium hydroxide. Steam is sparged into the formed slurry as it proceeds down the length of the slightly inclined drum. In greater detail, each drum is 30.5 m long and 5.5 m in diameter. Each such drum is fed about 4500 tph of oil sand, 1100 tph of hot water (95° C.) and 5 tph of aqueous 10% caustic solution. Steam is injected into the slurry, as required, to ensure a final slurry temperature of about 80° C. The retention time in the drum is about 3 minutes.

The process in the tumbler seeks to attain several ends, namely:

- heating the viscous bitumen, to reduce its viscosity and render it more amenable to separation from the sand grains;
- dispersing the heated bitumen from the solids and into the water;
- ablating or disintegrating the normally present lumps of oil sand, so that they will not be lost with oversize rocks in a screening step which immediately follows tumbling;
- entraining air bubbles in the slurry;
- coalescing some small bitumen flecks into larger flecks to make them amenable to aeration and subsequent separation; and
- aerating bitumen flecks by contacting them with air bubbles, whereby the bitumen coats the air bubbles.

The expression, used in the industry to identify the sum total of these various actions, is "conditioning" the slurry. A definition is given below with respect to when conditioning is "complete" for the purposes of this invention.

After being conditioned in the tumbler, the slurry is screened, to reject oversize, and simultaneously is diluted with additional hot water to produce a slurry having about 50% solids by mass (based on the initial oil sand feed).

The screened, diluted slurry is fed into a large, thickener-like vessel referred to as a gravity separation vessel or primary separation vessel (or "PSV"). The vessel is open-topped, having a cylindrical upper section and a conical lower section equipped with a bottom outlet. The diluted slurry is temporarily retained in the PSV for about 45 minutes in a quiescent state. The coarse solids sink (having a density of about 2.65), are concentrated in the cone, and exit through the bottom outlet as a fairly dense tailings stream. The non-aerated bitumen flecks have a density of about 1.0 and thus have little natural tendency to rise. However, the bitumen has an affinity for air. Because of this property, some of the non-aerated bitumen flecks form films around the air bubbles present in the slurry and join with the aerated bitumen created in the tumbler in rising to form bitumen froth at the surface of the slurry. This froth overflows the upper lip of the vessel into a launder and is recovered. The froth recovered in this manner is referred to as "primary bitumen froth". The process conducted in the PSV may be referred to as involving "spontaneous flotation".

The watery suspension remaining in the central portion of the PSV contains some residual bitumen. Much of this bitumen was not sufficiently aerated so as to be recovered as primary froth from the PSV. Therefore it is necessary to further process this fluid to recover the remaining bitumen. This is done by means of vigorously sub-aerating and agitating the fluid in one or more secondary recovery vessels. For example, a dragstream of the middlings from the PSV may be fed to a series of sub-aerated flotation cells. A yield of bitumen froth, termed secondary froth, is recovered. Flotation in the PSV may be referred to as "spontaneous flotation" while flotation in the secondary recovery vessels may be referred to as "forced air flotation".

The combination of the PSV and the subsequent secondary recovery means is referred to herein as the "separation circuit".

The primary bitumen froth is formed under quiescent condition and hence has less entrainment of gangue material. Thus it is considerably "cleaner" than secondary froth, in that it contains less water and solids contaminants. So it is desirable to produce the bitumen in the form of primary froth, to the greatest extent possible.

If conditioning has been properly accomplished, the following desirable results are achieved:

- the total recovery of bitumen obtained, in the form of the sum of primary and secondary froth, is high;
- the loss of bitumen with the tailings is low; and
- the bitumen is predominantly recovered in the form of primary froth.

At this point it is appropriate to make the point that the nature of the oil sand being processed has a marked influence on the results that are obtained. If the oil sand is of "good" grade (i.e. high in bitumen content—e.g. 13.2% by weight—and low in—325 mesh solids—e.g. 15% by weight) it will process well, giving:

- a high total bitumen recovery (e.g. 95%); and
- low bitumen losses with the tailings (e.g. 3%).

If the oil sand is of "poor" grade (i.e. low in bitumen content (e.g. 8%) and high in fines content (e.g. 30%), it will process relatively poorly, giving:

- a low total bitumen recovery (e.g 85%); and
- high bitumen losses with the tailings (e.g. 12%).

In summary then, the conventional extraction circuit comprises a tumbling step that is designed to condition the slurry. Tumbling is followed by a sequence of spontaneous and forced air flotation steps. If conditioning is properly conducted, the total bitumen recovery and bitumen loss values for different grades of feed will approximate those illustrative values just given.

Now, it has long been commonly known that particulate solids may be slurried in water and conveyed by pumping them through a pipeline, as an alternative to using conveyor belt systems.

However, to the best of our knowledge the public prior art is silent on whether oil sands can successfully be conveyed in this fashion, as part of an integrated recovery process. More particularly, the literature does not teach what would occur in such an operation.

The present invention arose from an experimental project directed toward investigating pipeline conveying of oil sands in aqueous slurry form.

The project was carried out because it was hoped that pipelining a slurry of oil sand might prove to be a viable substitute for the conveyor belt plus tumbler system previously used to feed the separation circuit. There were questions that needed to be answered to establish this viability. The answers to these questions were not predictable. More particularly, it was questionable whether:

- sufficient bitumen in the oil sand slurry would become properly aerated in a pipeline so as to yield:
  - a high total bitumen recovery, and
  - a high primary oil froth recovery; or the bitumen would become excessively emulsified in the course of being pumped a long distance through a pipeline, so that the bitumen would become difficult to recover from the slurry.

SUMMARY OF THE INVENTION

The present invention is based on having made certain experimental discoveries, namely:

- That if a slurry, comprising oil sand, water and process aid, is formed so as to entrain air bubbles and is pumped through a pipeline a distance in the order of about 2.5 km (which is commonly less than the distance between the surface mine and the extraction plant), complete conditioning of the slurry is achieved. More particularly, a sufficient quantity of the contained bitumen becomes aerated and is rendered buoyant. As a result, the slurry may be introduced directly into the PSV of a conventional separation circuit, in which PSV spontaneous flotation takes place to yield total recovery, underflow loss, and froth quality values that are comparable to those obtained by a conventional extraction train involving a tumbler and separation circuit;
- That the slurry may be at a relatively low temperature (e.g. in the order of 50° C.) and yet conditioning may still be successfully completed as aforesaid;
- That there is a "conditioning breakover point" for a particular slurry during the course of passage through a particular pipeline. More particularly, with increasing retention time up to the breakover point, there is:
  - an increase in subsequent total bitumen recovery from the separation circuit, and
  - a diminishment in subsequent losses of bitumen with the underflow tailings from the separation circuit.

The breakover point indicators when conditioning is "complete". Such complete conditioning of the slurry is reflected in the total recovery and tailings loss values resulting from subsequent processing of the slurry in a conventional separation circuit. More particularly, the total recovery of bitumen will exceed 90% by weight and the tailings loss of bitumen will be less than 10%, with respect to a feed of sufficient quality to be acceptable for a conventional extraction circuit. Preferably the total recovery of bitumen and bitumen losses for good and poor grade oil sands will be of the order of those values previously stated;
- That if the slurry is pumped further through the pipeline after conditioning is complete, significant emulsification does not occur. Stated otherwise, the total recovery and tailings loss values remain generally constant, even though retention time in the pipeline far exceeds that required to complete conditioning; and That if the completely conditioned slurry is subjected to separation of the coarse solids (as by settling) part way along its passage through the pipeline, it is found that the solids will readily separate in a substantially clean condition. Stated otherwise, once completely conditioned, passage of the slurry through the pipeline may be interrupted and the coarse solids may be separated without appreciable bitumen loss. The remaining slurry may then be pumped through the pipeline the remainder of the distance to the extraction plant.

Having ascertained these unpredictable discoveries, applicants conceived the following process:

As a first preferred step, the oil sand oversize is removed, by crushing or screening, prior to mixing, to reduce lumps to a size less than about ⅓ of the internal diameter of the pipeline. If the lumps are too large, plugging of the line can ensue.

The oil sand is mixed at the mine site with hot water typically at 95° C.) and, preferably, alkaline process aid (usually sodium hydroxide), in a manner whereby air bubbles are entrained, to form an aerated slurry having a composition and temperature falling within the following preferred ranges:

| Component | % by weight |
|---|---|
| oil sand | 50–70 |
| water | 50–30 |
| process aid | 0.00–0.05 |
| Slurry Temperature (°C.) | 40–70 |

The slurry is then pumped through a pipeline from the mine site to an extraction plant. The pipeline must be of sufficient length so that substantially complete conditioning of the oil sand occurs. Preferably, the slurry is moved through a first section of the pipeline, in which substantially complete conditioning is accomplished, and then separation of substantially all of the coarse solids (i.e. greater than 200 mesh) is effected at this point. This may be accomplished by gravity or enhanced settling, such as with cyclones. Depending on the density of the slurry, dilution with water may be required for good separation. The remaining slurry is then pumped through a second section of the pipeline to the extraction plant. On reaching the extraction plant, the slurry is introduced directly into a conventional separation circuit comprising spontaneous and forced air flotation units. By "directly" is meant that the slurry is not processed in a tumbler on its way to the gravity separator or PSV. It is found that the total recovery of bitumen from the separation circuit exceeds 90% of that contained in the oil sand feed and the tailings losses are less than 10%.

Broadly stated, the invention is a process for simultaneously transporting and conditioning naturally water-wet oil sand to enable recovery of bitumen in a conventional gravity separation vessel, comprising: surface mining oil sand at a mine site; mixing the oil sand, at the mine site, with hot water and process aid, if required, and entraining air in the fluid during mixing to form an aerated slurry; pumping the slurry through a pipeline from the mine site to a bitumen extraction plant, said pipeline being of sufficient length so that separation of bitumen from sand and subsequent aeration of the bitumen both occur, to render the aerated bitumen buoyant; and introducing the slurry from the pipeline directly into a gravity separation vessel and processing it therein by gravity separation under quiescent conditions to recover bitumen in the form of froth.

The term "surface mining" is intended to be broadly interpreted and could, for example, extend to dredging.

BRIEF DESCRIPTION OF THE DRAWINGS

FIG. 14 is a plot of bitumen recovery versus distance pipelined for the Base Mine "A" oil sand.

DESCRIPTION OF THE PREFERRED EMBODIMENT

Experimental work was conducted that led to the process discoveries previously described. This work entailed three separate pilot programs of increasing scale, two of which are described below.

Figure 1:
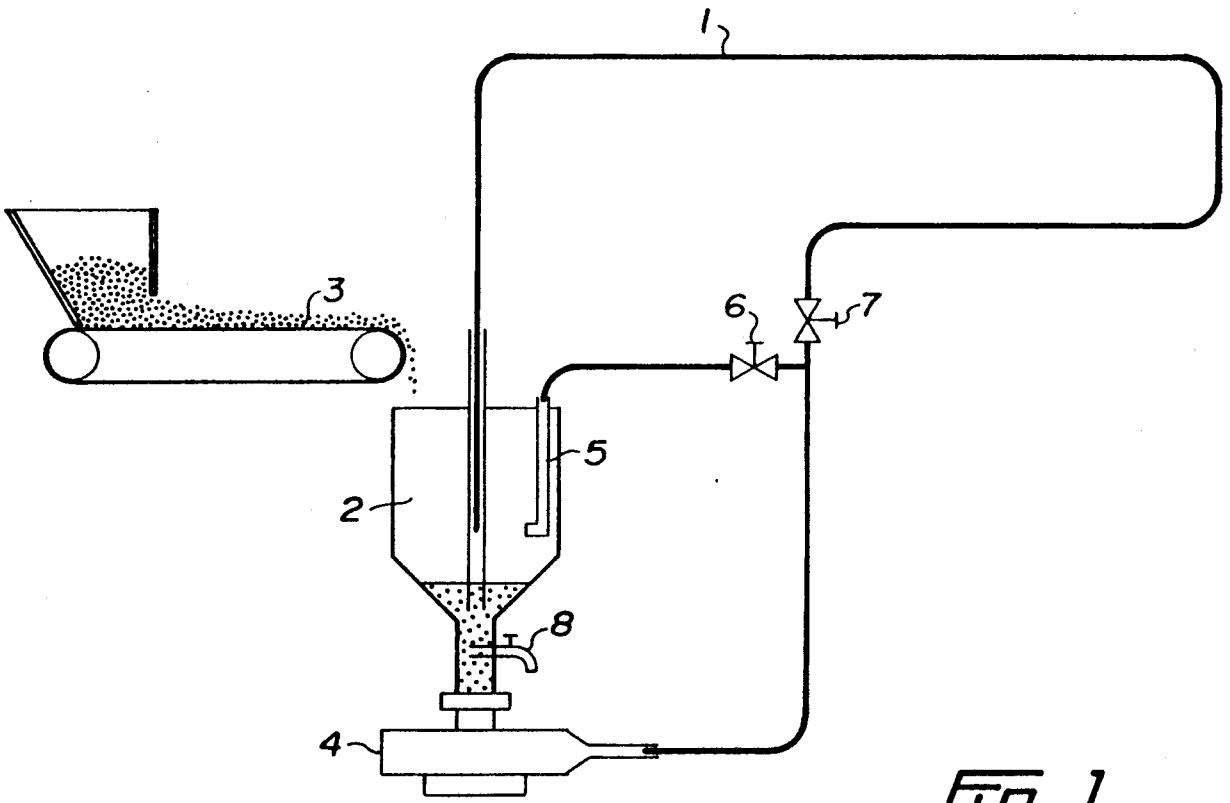
FIG. 1 is a schematic of the laboratory circuit used in connection with development of the invention.

More particularly, some of the data presented was developed in a pilot pipeline loop 1, schematically shown in FIG. 1. The loop 1 was 230 feet long and had an internal diameter of 2 inches. The loop 1 was connected with a pump box 2. Oil sand could be fed to the pump box 2 by a conveyor 3. A positive displacement pump 4 was connected to the bottom outlet of the box 2. Slurry could be re-circulated back into the pump box 2 from the initial section of the loop 1 via a pipe leg 5. Valves 6,7 controlled the leg 5 and loop 1 (downstream of the leg 5) respectively. In operation, the pump box 2 would be filled with an amount of water in excess over that required to fill loop 1. Valve 6 would be opened and valve 7 closed. Oil sand would then be fed into the pump box 2 and the mixture circulated through the box 2 tangentially to entrain air and form an aerated slurry. In some runs, sodium hydroxide, in the form of a 10% solution, was added at the pump box; in other runs, no sodium hydroxide was added. Recirculation was continued for 30 seconds, to form the slurry. After such circulation, the valve 7 was opened and the valve 6 closed, so that the full loop 1 was now in use. Circulation through the full loop would then be continued for the retention time required to establish the pipeline distance to be travelled by the slurry. In a typical run, 105 kg of oil sand were added to 42 kg of hot water (having a temperature of 90° C.), to yield a slurry having a temperature of 50° C. Samples of the slurry were periodically withdrawn through the valve 8 at the outlet from the box 2. The pump speed was adjusted to provide a slurry velocity of 8 feet/second.

It is to be noted that the slurry water content (30–50%) was higher than that in the slurry processed in a conventional tumbler (18–25%).

To compare the conditioning accomplished in the pipeline with that of the conventional tumbler circuit, slurry withdrawn from the loop 1 was tested in a laboratory scale separation circuit. More particularly, withdrawn samples were treated as follows:

- A slurry sample of 300 mL was collected in a 1 L jar already containing 300 mL of water having a temperature of 50° C. (so that the resultant mixture now corresponded in water content with that of the diluted slurry conventionally fed to a primary separation vessel), and stirred;
- The diluted sample was settled for 1 minute under quiescent conditions, to allow froth to rise by spontaneous flotation and solids to settle;
- The froth (which was the "primary" froth) was skimmed off and analyzed for bitumen, water and solids;
- The aqueous layer was decanted off and saved;
- The coarse solids were washed with 150 ml of 50° C. water by capping the jar and rotating it gently 5 times. After settling for 1 minute, the aqueous phase was decanted and saved. This washing procedure was repeated twice more;
- The washed solids were analyzed for oil, water and solids;
- The water decant fractions were combined. The product was subjected to induced air flotation at an impeller speed of 800 rpm and air rate of 50 mL/minute. The temperature of the charge was maintained at 50° C. and air addition was continued for 5 minutes. Secondary froth was produced and collected. This secondary froth and the residual tailings were analyzed for bitumen, water and solids.

The analytical methods used to determine the oil, water and solids contents were those set forth in "Syncrude Analytical Methods for Oil Sand and Bitumen Processing", published by The Alberta Oil Sands Technology and Research Authority (1979).

The previously described laboratory scale process has been used many times in the past by assignee's research group and the results obtained have been shown to closely correspond with those from the separation circuit in the commercial plant of the assignees of this invention.

The various bitumen fractions were established using the following relationships:

$$\%\ \text{primary recovery} = \frac{\text{bitumen in primary froth}}{\text{total bitument in feed}} \times 100\%$$

% total recovery =

$$\text{bitumen in primary and} \frac{\text{secondary froths}}{\text{total bitumen in feed}} \times 100\%$$

% bitumen lost to coarse tailings =

$$\frac{\dfrac{\text{bitumen in coarse solids}}{\text{total solids in slurry}}}{\dfrac{\text{bitumen in oil sand}}{\text{total solids in oil sand}}} \times 100\%$$

% bitumen not amenable to flotation =

$$\frac{\dfrac{\text{bitumen in secondary tailings}}{\text{total solids in slurry}}}{\dfrac{\text{bitumen in oil sand}}{\text{total solids in oil sand}}} \times 100\%$$

Distance pipelined (km) = elapsed time from start of run × pipeline velocity

Two oil sands were used in the tests, as follows:

| | |
|---|---|
| Ore "A" - "good" grade | 13.2% bitumen<br>15.0% fines |
| Ore "B" - "poor" grade | 9.2% bitumen<br>28.0% fines |

Figure 2:
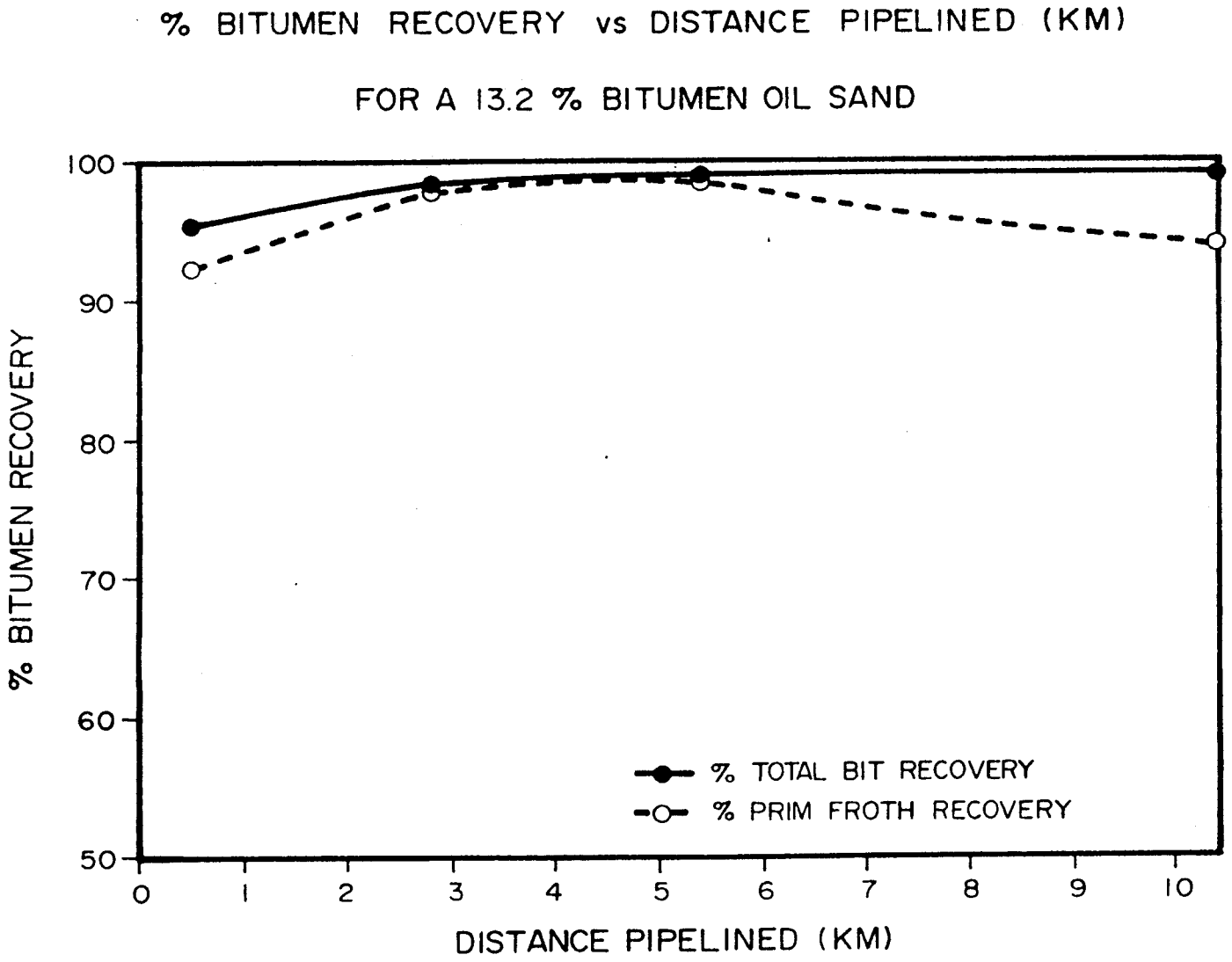
FIG. 2 is a plot showing bitumen recovery variation with distance pipelined, for a 13.2% bitumen-containing oil sand treated in the laboratory circuit of FIG. 1.

Having reference to FIG. 2, it will be noted that, at a distance pipelined of about 2.5–3 km, the following results occurred for runs using a good grade oil sand:

| | |
|---|---|
| Dec. 9 runs: | |
| Total bitumen recovery | 97% |
| Primary froth recovery | 96% |
| Jan. 12 runs: | |
| Total bitumen recovery | 95% |
| Primary froth recovery | 92% |

The recovery and losses reached fixed values and remained virtually constant after the breakover point.

Figure 3:
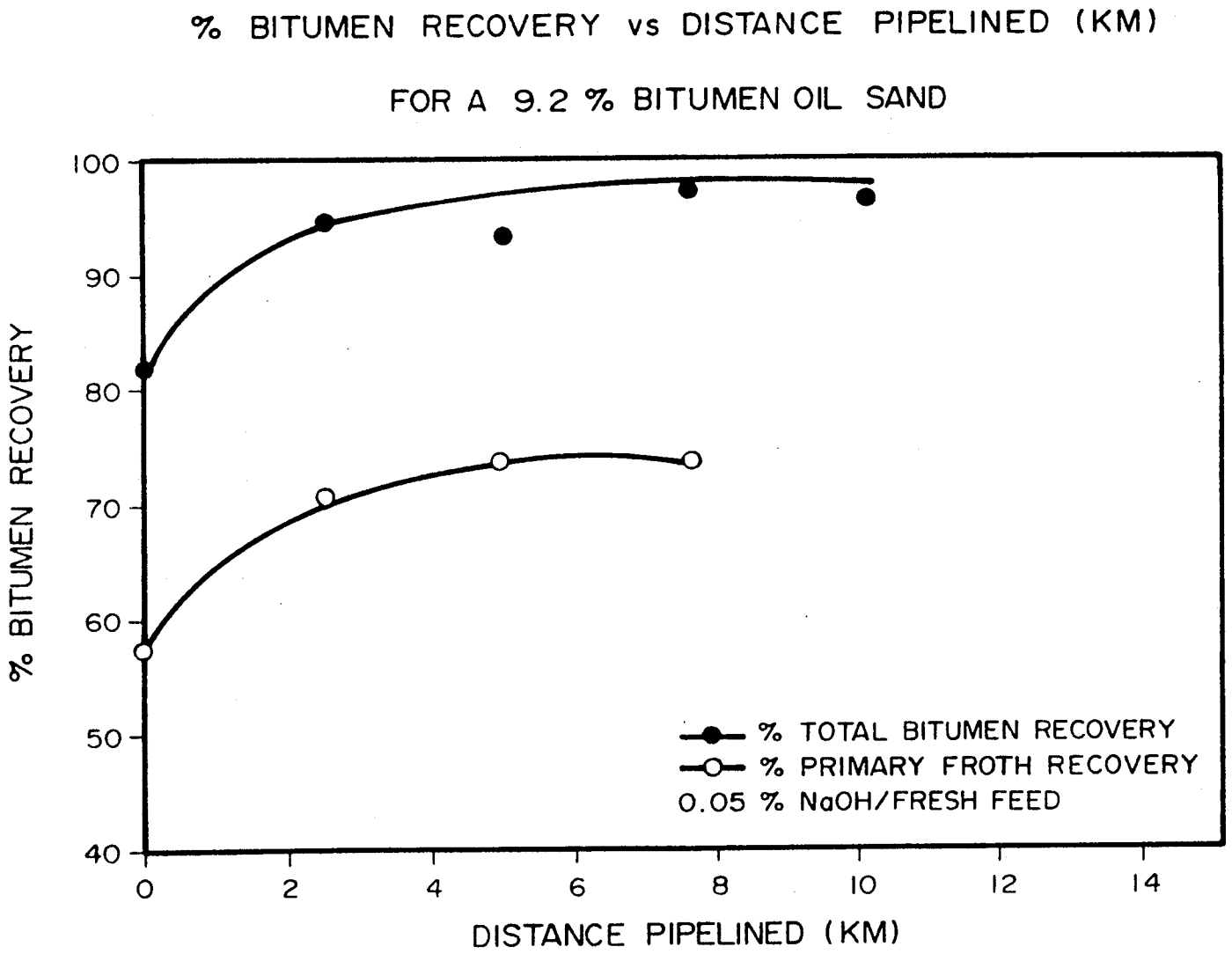
FIG. 3 is a plot showing bitumen recovery variation with distance pipelined, for a 9.2% bitumen-containing oil sand treated in the laboratory circuit of FIG. 1.

Having reference to FIG. 3, at a distance pipelined of about 3 km (i.e. the breakover point) the following results occurred for a poor grade oil sand with the optimum amount of sodium hydroxide (0.05 wt %):

| | |
|---|---|
| Total bitumen recovery | 93% |
| Primary froth recovery | 72% |

The same group of runs also show:

| | |
|---|---|
| Bitumen lost with primary tailings | 2% |
| Bitumen that remained with secondary tailings | 5% |

Figure 4:
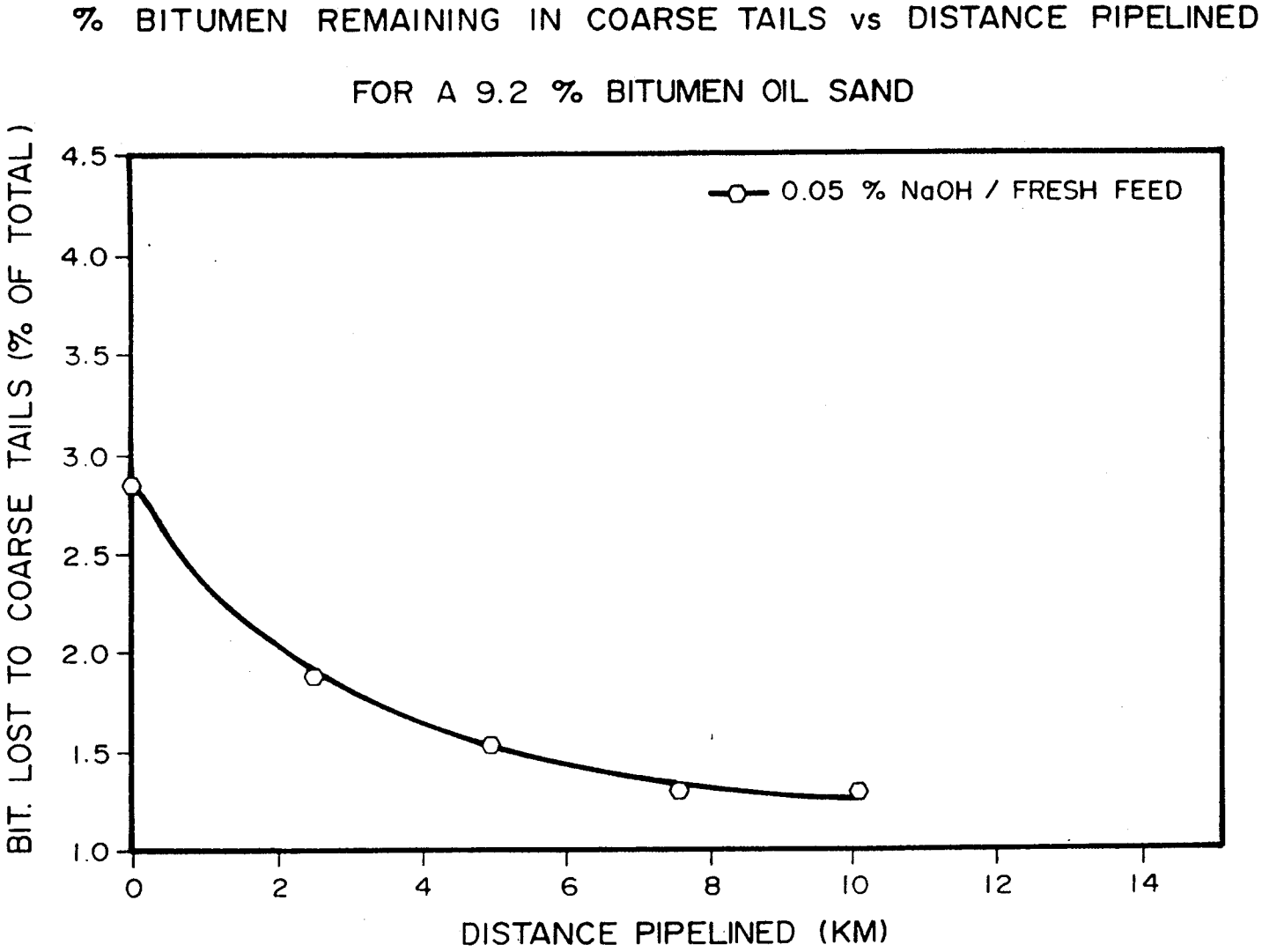
FIG. 4 is a plot showing the variation in bitumen lost with the tails with distance pipelined for a 9.2% bitumen-containing oil sand treated in the laboratory circuit of FIG. 1.
Figure 5:
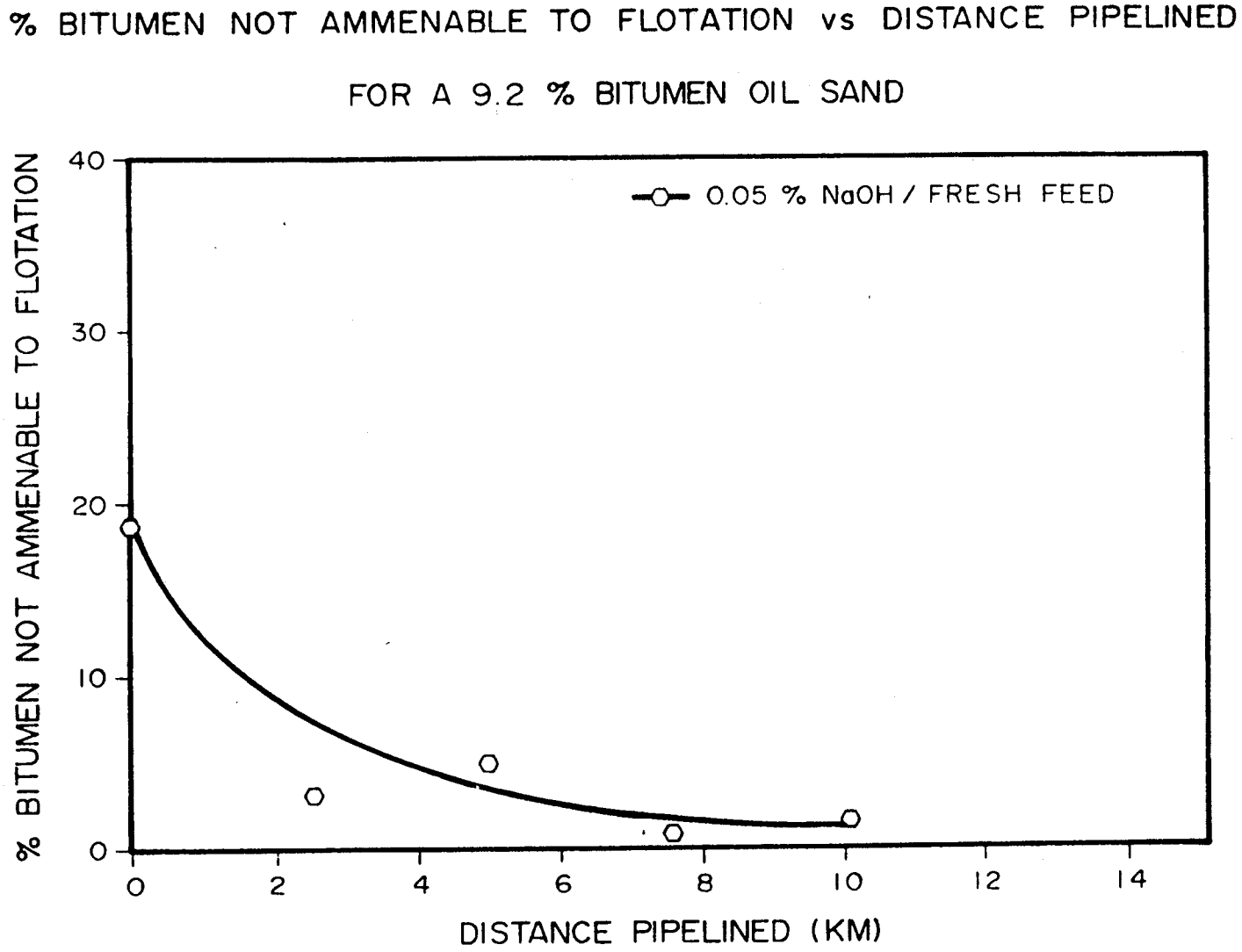
FIG. 5 is a plot showing the variation in percent of bitumen not amenable to flotation with distance pipelined for a 9.2% bitumen-containing oil sand treated in the laboratory circuit of FIG. 1.

Plots of oil losses to primary tailings, and oil remaining in secondary tailings are given in FIGS. 4 and 5 respectively.

The following conclusions are apparent from the data, namely:

- That pipelining an oil sand slurry beyond the point where conditioning is complete does not over-condition the slurry;

That conditioning is complete within a short distance travelled, said distance being substantially less than the distance between the mine and the plant (for most of the plant life in a typical case);

That pipelining slurry will produce primary and total bitumen recoveries as good as or better than those from a conventional tumbler/flotation train;

That, following completion of conditioning, the coarse solids may be separated without prohibitive bitumen losses;

That a slurry conditioned in a pipeline can be fed directly to a separation circuit and the bitumen recoveries and losses will be found to be comparable to those obtained with a slurry conditioned in a tumbler; and That process aids are required for low grade oil sand to achieve good recoveries.

Figure 6:
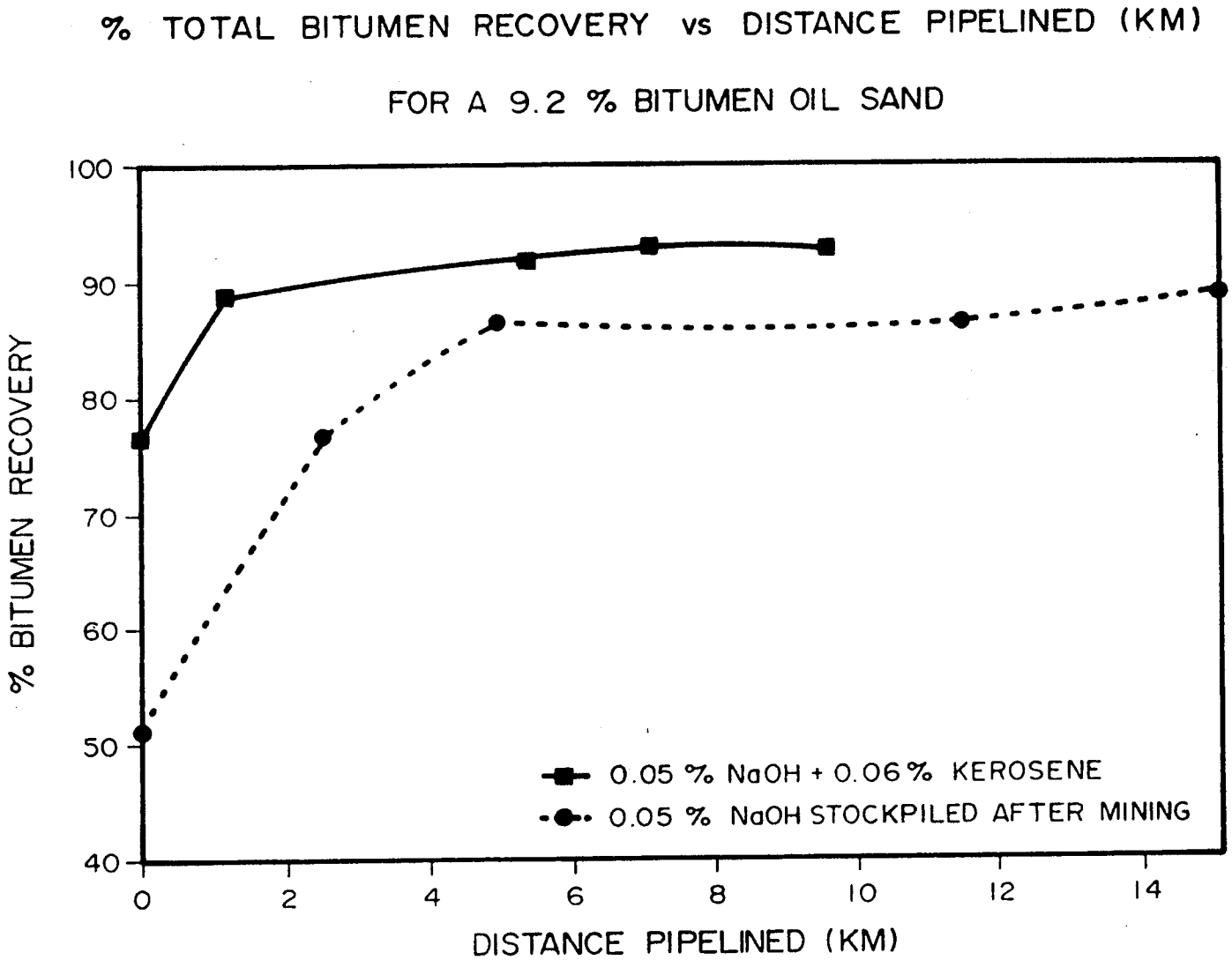
FIG. 6 is a schematic of an industrial scale system for practising the process.

Turning now to FIG. 6, there is schematically shown a recommended system for practising the invention.

Figure 7:
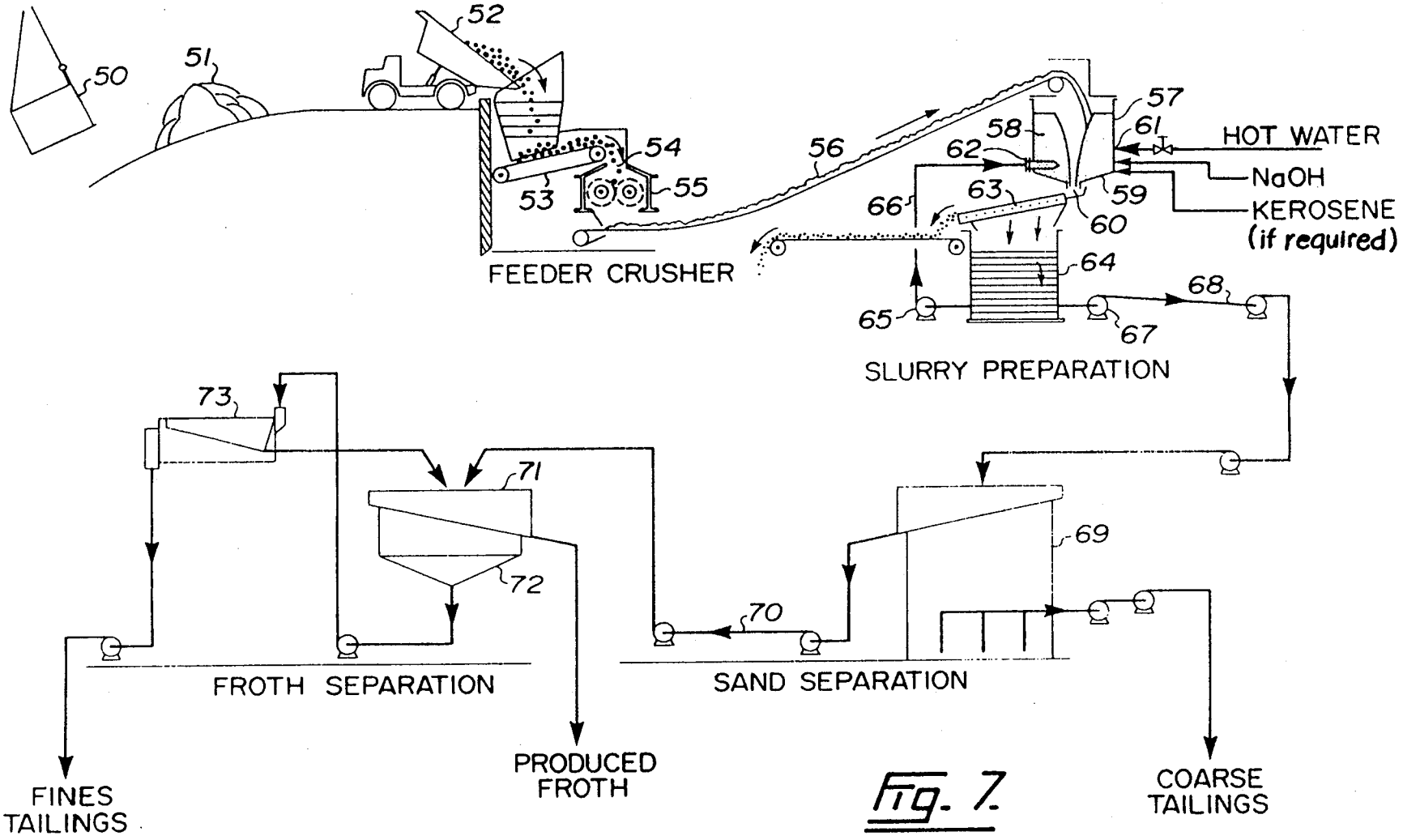
FIG. 7 is a schematic showing the invention in the context of operating between the mine site and a bitumen extraction plant comprising primary and secondary separation.

More particularly, oil sand is surface mined and deposited in a feed bin. The oil sand is then fed to a crusher 55 of the double roll type, to reduce the oversize to less than 24". The crushed oil sand is fed by conveyor 56 to a mixer 57. This mixer 57 is shown in FIG. 7. It comprises an open-topped cylindrical vessel 58 having a conical bottom 59 with a central outlet 60. A pair of tangential inlets 61, 62 extend into the base of the vessel chamber 58. Fresh hot water, containing caustic, is fed into chamber 58 via the inlet 61. Recycled hot slurry is fed in via inlet 62. The oil sand is mixed with the slurry and water and caustic streams, which are circulating in the form of a vortex in the chamber 58, and air bubbles are entrained into the slurry. The hot water and caustic additions are controlled to yield a slurry typically having the following values:

| | |
|---|---|
| water content | 35% |
| NaOH content | 0.01% |
| Temperature | 55° C. |

The product slurry leaves the chamber 58 through the bottom outlet 60, passes through a screen 63 that removes oversize and enters a pump box 64. The recycled slurry is withdrawn from pump box 64 and returned by pump 65 and line 66 to the inlet 62. Slurry is pumped by pump 67 from pump box 64 into pipeline 68. The slurry is conveyed through a first section of pipeline 68, far enough to completely condition the slurry. The extent of conditioning may be established using laboratory equipment and procedures as previously described. At this point, the slurry is diluted and introduced into a settler 69 and retained under quiescent conditions, to allow the coarse solids to settle. The solids are removed as tailings and discarded. In this manner, 60 to 70% of the total mass of slurry is eliminated. The remaining slurry is pumped through a second section 70 of pipeline to a conventional separation circuit 71. Here the slurry is subjected to spontaneous flotation in a primary separation vessel 72 and middlings from the vessel 72 are subjected to forced air flotation in cells 73 to produce primary and secondary froth.

It will be noted that the slurry temperature (55° C.) is considerably less than the conventional temperature (~80° C.). If a tumbler were to be used with such a "low temperature" slurry, it would have to be very large, to provide a longer retention time. By the combination of conditioning in a pipeline and feeding conditioned slurry directly to the PSV, a low temperature process is now feasible.

The invention was further tested in a larger scale field pilot test of multiple runs, each involving continuous mixing to produce slurry, once-through pipelining at constant velocity through distances between 0 km and 2.5 km, and gravity separation/flotation in a separation vessel.

Figure 8:
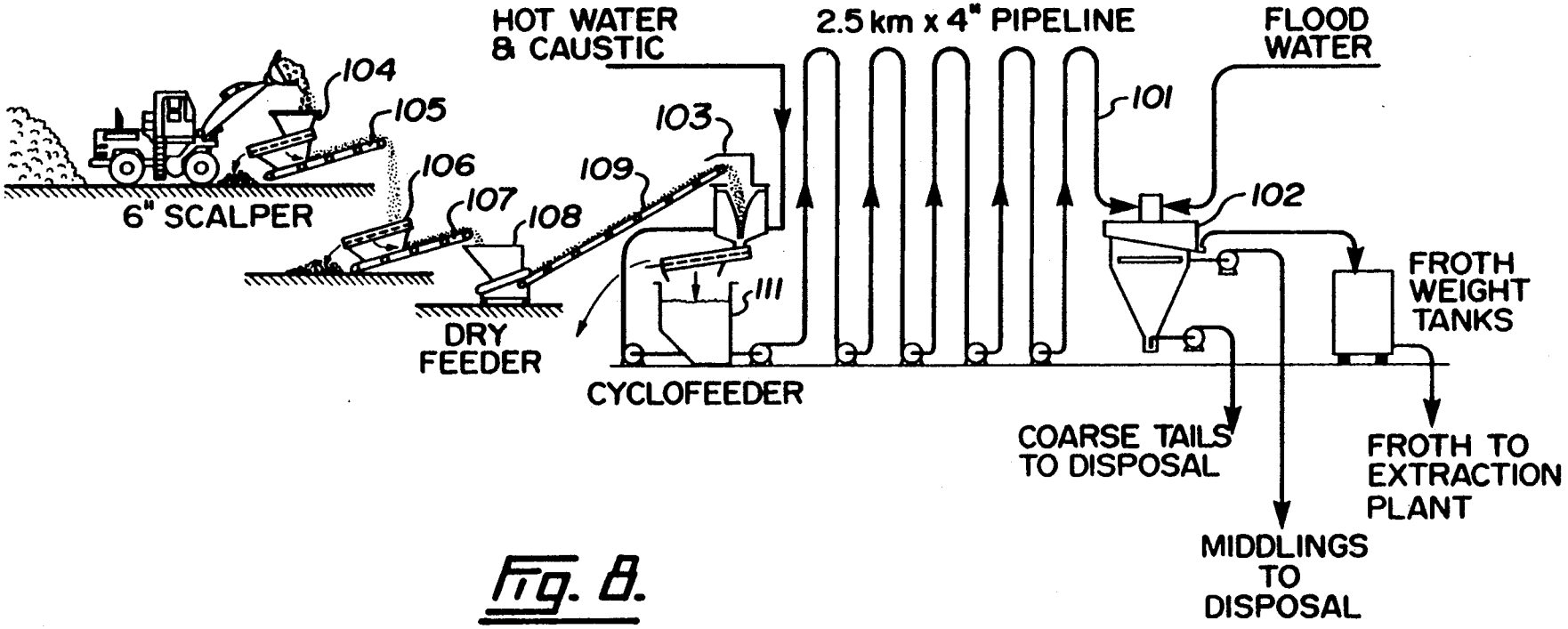
FIG. 8 is a schematic showing the 4 inch pipeline pilot.

The process schematic of the facility used to conduct this test is shown in FIG. 8.

As stated, the test involved a continuous, once through system which involved a mixer assembly 100, previously described and hereinafter referred to as the cyclofeeder, 2.5 km of 4 inch pipeline 101 and a deep cone primary separation vessel 102. The system operated at an oil sand feed rate of 100 tonne per hour.

The objectives of this pilot test were as follows:

to demonstrate the viability of the cyclofeeder/pipeline system as an alternative to the conventional conveyor/tumbler system;

to evaluate bitumen recovery and froth quality from oil sand slurry produced as a result of pipeline transportation;

to test the system with oil sands of different grades; and to study the effect of pipeline length (conditioning time).

The test verified that sufficient slurry conditioning could be achieved in a pipeline to enable viable bitumen recovery from subsequent processing in a primary separation vessel. The bitumen recoveries and froth bitumen contents were comparable to those from applicant's conventional hot water extraction plant. The recoveries improved With the distance pipelined, but levelled off by 2.5 km (a residence time of 14 minutes). The solids content in the primary froth from the primary separation vessel (PSV) increased with the distance pipelined and the content was slightly greater than conventional PSV froth. A system comprising the cyclofeeder 100 and pipeline 101 was shown to be a viable alternative to the conventional equipment comprising conveyors and tumblers.

The cyclofeeder 100 was demonstrated to be a viable means for continuously forming the oil sand slurry. Operation of this unit involved a fast rotating vortex formed in the mixer 103, which vortex was created by partial recirculation of screened slurry. This vortex was utilized to disperse and suspend the stream of oil sand being fed into the mixer 103. The cyclofeeder tested was able to continuously and consistently produce high density oil sand slurries.

Figure 9:
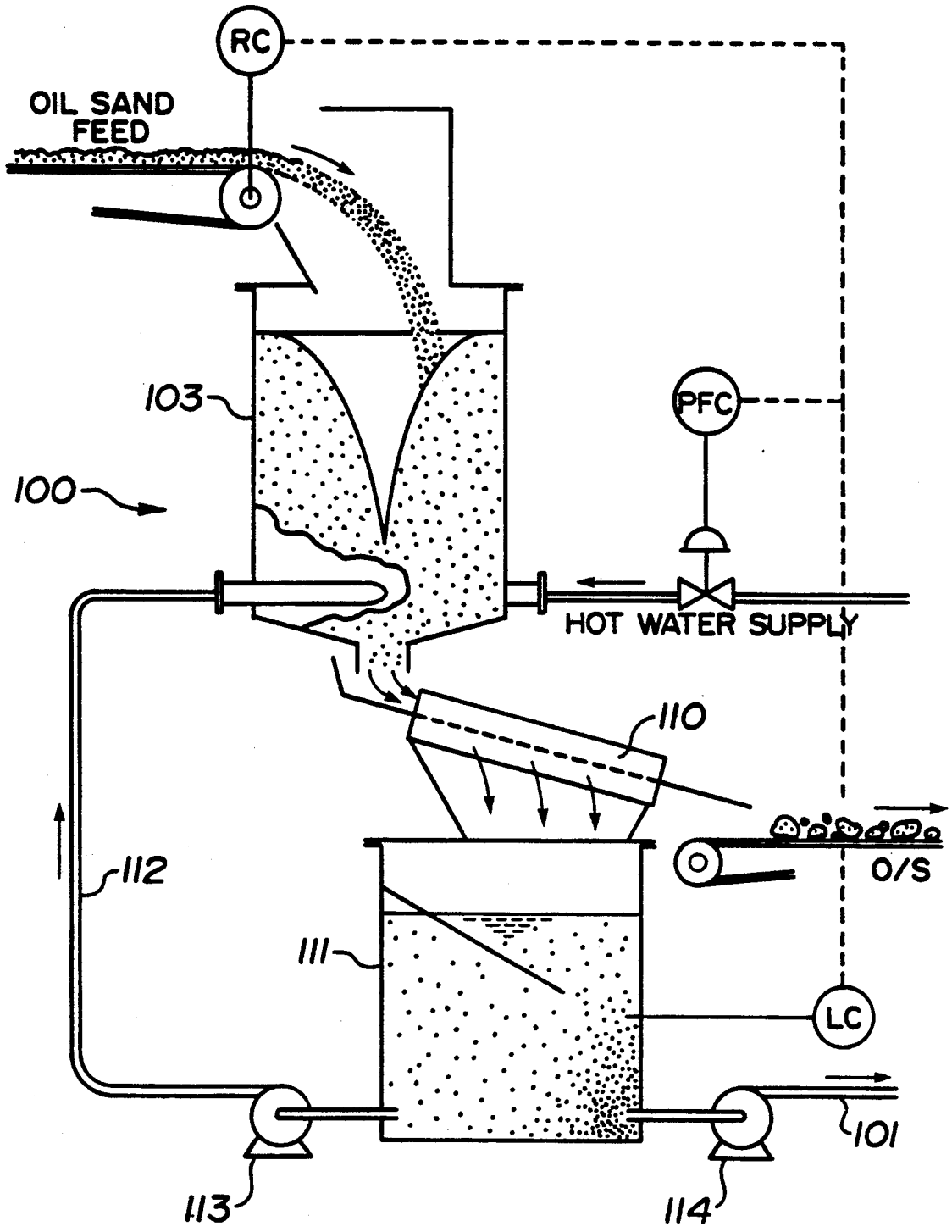
FIG. 9 is a schematic showing the cyclofeeder used in the pilot of FIG. 8.
Figure 10:
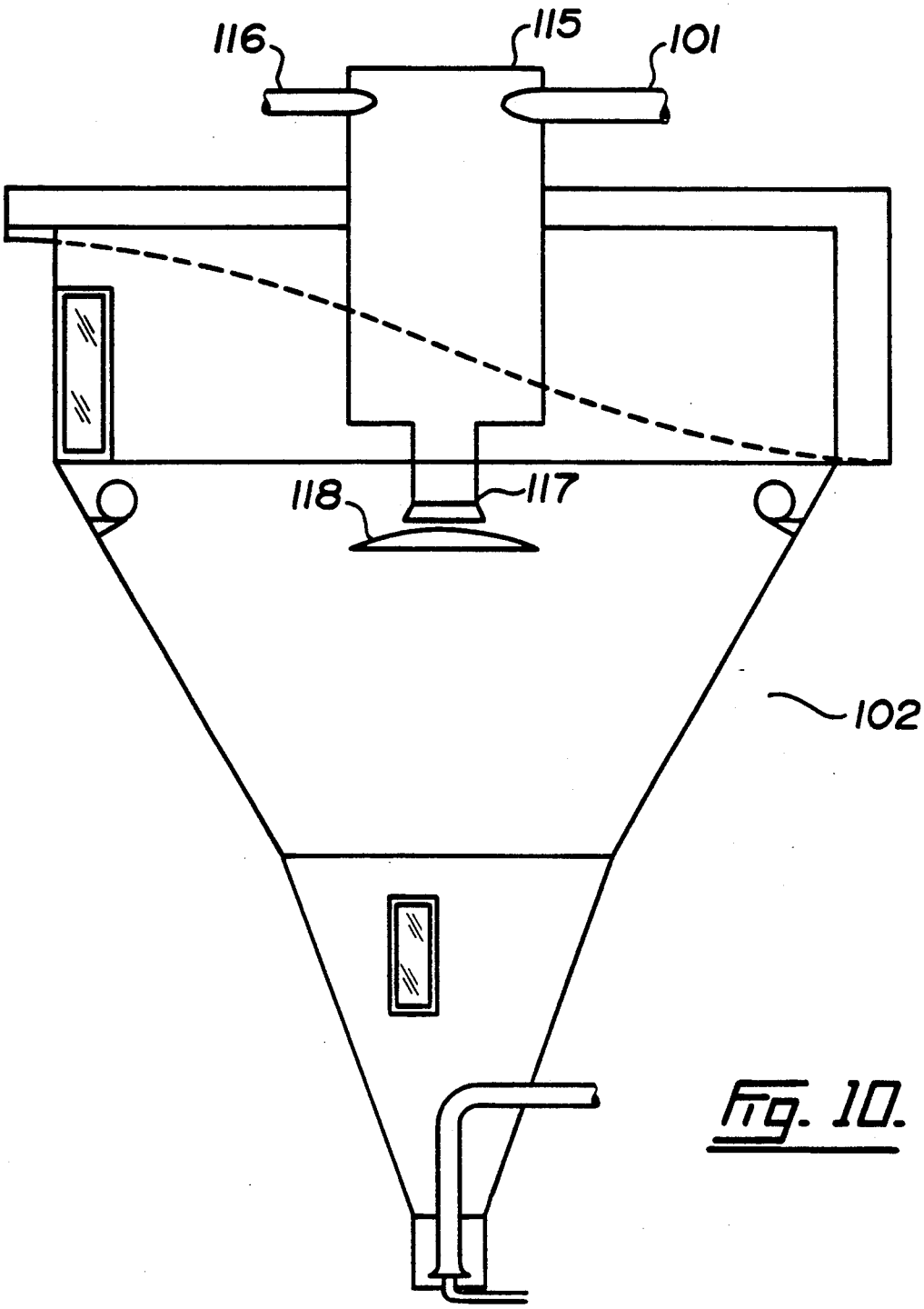
FIG. 10 is a side sectional view of the primary separation vessel (PSV) used in the pilot of FIG. 8.

Turning now to the specifics of the test equipment, the process conditions and the results, the following was involved:

The processing line began with a vibrating grizzly scalper 104 having 6×12 inch openings. A belt conveyor 105 fed the scalper product to a dry screen 106 having 4×4 inch openings. The product from the screen was fed by a belt conveyor 107 to the feeder 108 of a belt conveyor 109. The belt conveyor 109 fed the oil sand into the mixer 103. The assembly so described delivered 100 tonnes per hour of oil sand to the mixer 103;

The cyclofeeder 100, shown in FIG. 9, involved the mixer 103 (shown in FIG. 8), screen 110, and pump box 111. Slurry was recycled from the pump box 111 to the mixer 100 through the line 112 by a recirculation pump 113. The recycled slurry was jetted tangentially into the mixer 100, as was a stream of fresh water (95° C.) and caustic as required. The recycled slurry (60 $dm^3/S$) maintained the vortex in which mixing took place. The mixer 100 discharged onto the vibrating screen 110, which removed the +¾ inch solids. The product slurry from the screen 110 passed into the pump box 111. Up to 22 $dm^3/S$ of dense oil sand slurry (1.65 $kg/dm^3$) was generated at temperatures up to 60° C.;

The slurry was pumped from the pump box 111 through the pipeline 101 which was formed in five 500 m sections connected by a series of pumps 114. The operating length of the pipeline could be varied in section increments from 0 to 2.5 km. Samples could be taken at intervals along the pipeline;

The pipeline 101 discharged into a mixing well 115 in the upper end of the deep cone primary separation vessel (PSV) 102. The entering slurry was diluted with floodwater (60°) introduced into the mixing well 115 through line 116, to reduce the product density to about 1.50 $kg/dm^3$. The diluted slurry was discharged downwardly through outlet 117 and deflected to spread out laterally by plate 118. In the PSV, the slurry was separated into bitumen froth overflow, middlings and coarse tailings underflow. The froth flowed into a weighing tank 119. The middlings and tailings were discharged to a disposal pond;

The oil sand, slurry feed to the PSV, froth, middlings and tailings streams were sampled to determine bitumen recovery and material balances. All process streams were metered;

Five oil sands were tested in the program. Two were used for commissioning and are not pertinent. The average compositions of the other three oil sands are shown in Table I.

TABLE I

| Oil Sand | Auxiliary Pit "A" | Auxiliary Pit "B" | Base Mine "A" |
|---|---|---|---|
| Bitumen (wt %) | 10.3 | 7.5 | 11.3 |
| Water (wt %) | 3.8 | 7.0 | 3.2 |
| Solids (wt %) | 85.9 | 85.5 | 85.5 |
| % <44 um fines | 22.3 | 18.7 | 28.9 |

The three oil sands were from different locations and were of different composition. Runs were performed for each oil sand at pipeline lengths of 0 km, 1.5 km and 2.5 km. For the first oil sand, an additional series of mass balances was performed at 0.5 km. The velocity of the slurry in the pipeline was held constant at 3 +/−0.3 m/s. The slurry density was held constant at 1.6 +/−0.05 $kg/dm^3$ and the slurry temperature at 55 +/−5° C.;

A minimum of four mass balances were taken at 45 minute intervals during each run. For each mass balance, samples were taken for oil/water/solids (O/W/S) analysis of the oil sand, cyclofeeder rejects, slurry, PSV froth, PSV middlings and PSV tailings. All analyses were performed using the standard Dean-Stark Soxhlet Extraction method;

Samples of the middlings from the PSV were tested using a Denver cell (not shown) to determine secondary recovery of bitumen. In the Denver cell, the middlings were agitated and aerated for ten minutes. The secondary froth was then skimmed off and its composition determined;

The rejects were weighed and the bitumen losses determined.

Figure 11:
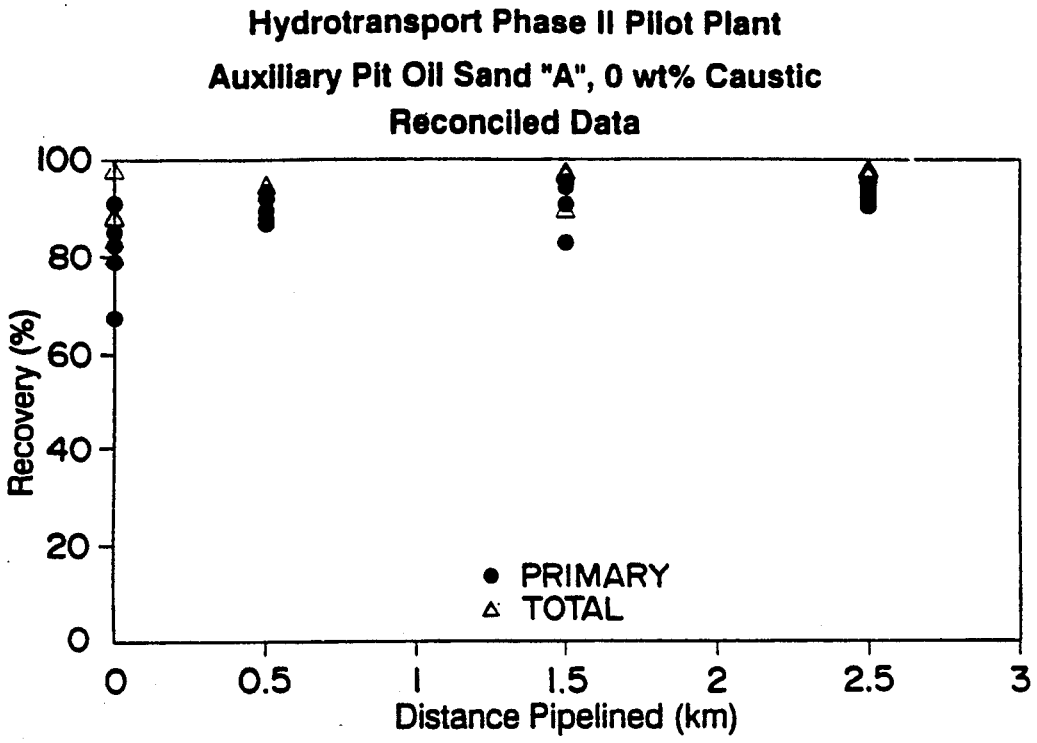
FIG. 11 is a plot of bitumen recovery versus distance pipelined for the Auxiliary Pit "A" oil sand.

FIG. 11 shows the effect of distance pipelined on froth quality of the oil sand from Auxiliary pit A. This oil sand processed well without caustic addition. Even when the slurry was pipelined directly from the cyclofeeder to the PSV, the primary bitumen recoveries averaged 81%. After 0.5 km of travel through the pipeline, both the primary and total recoveries had essentially levelled out, achieving average values of 90% and 94% respectively. Pumping the slurry over greater distance increased the bitumen recovery only slightly. These recoveries compare well with those obtained using the conventional tumbler/PSV circuit in applicants' plant.

Figure 12:
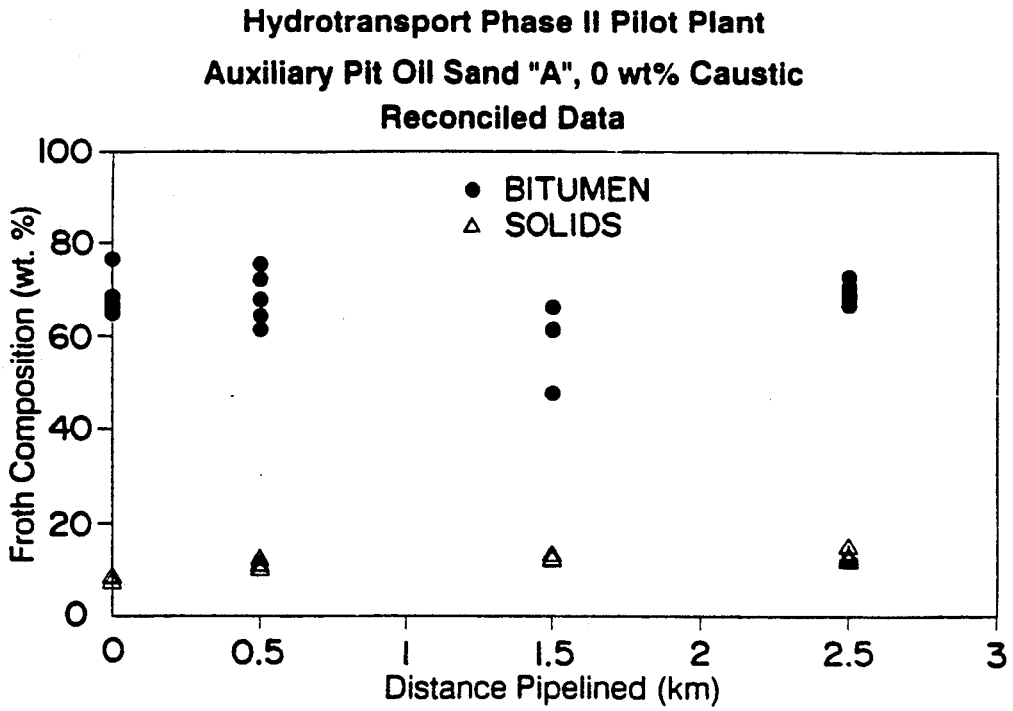
FIG. 12 is a plot of froth composition versus distance pipelined for the Auxiliary Pit "A" oil sand.

FIG. 12 shows the effect of distance pipelined on froth quality for the oil sand from Auxiliary pit A. The amount of bitumen in the froth shows no significant change with distance. The 67% average bitumen content in primary froth compares well with the result obtained in the conventional circuit. However, the average amount of solids in the froth increased from 7.9 up to 12.5 wt % as the distance pipelined increased from 0 km to 2.5 km.

Figure 13:
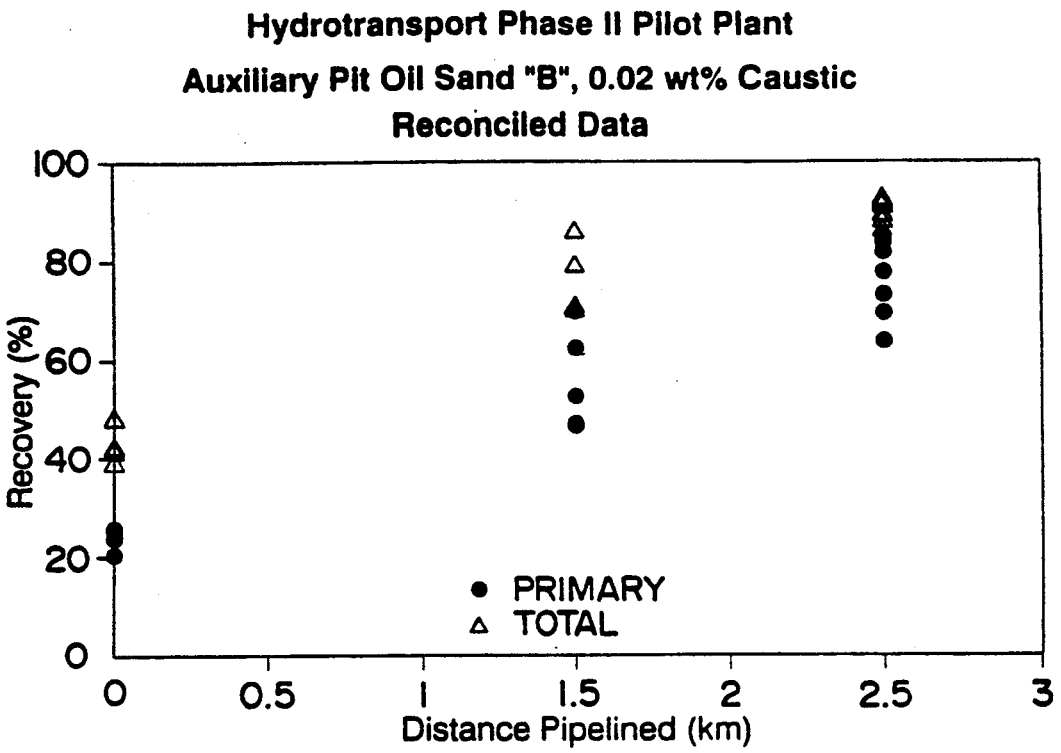
FIG. 13 is a plot of bitumen recovery versus distance pipelined for the Auxiliary Pit "B" oil sand.
Figure 14:
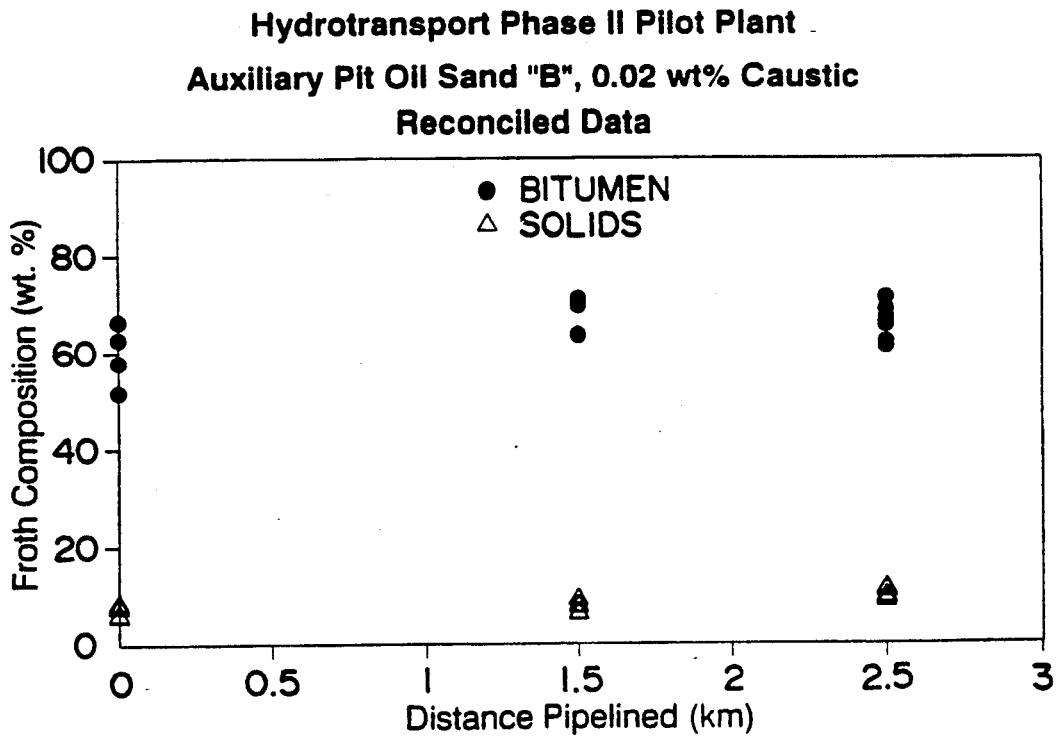
FIG. 14 is a plot of froth composition versus distance pipelined for the Auxiliary Pit "B" oil sand.

The results of processing the oil sand from Auxiliary Pit "B" are shown in FIGS. 13 and 14. This was a low grade oil sand. The oil sand processed very poorly when sent to the PSV directly from the cyclofeeder, giving average primary and total recoveries of 24% and 42% respectively. As shown in FIG. 13, these recoveries increased significantly as the conditioning time or distance pipelined increased. The total recovery after the full 2.5 km pipelining distance was 89%. As with the first oil sand, the amount of solids in the primary froth increased with distance pipelined. The maximum froth solids level reached was 9.9%, which is comparable to conventional results.

Figure 15:
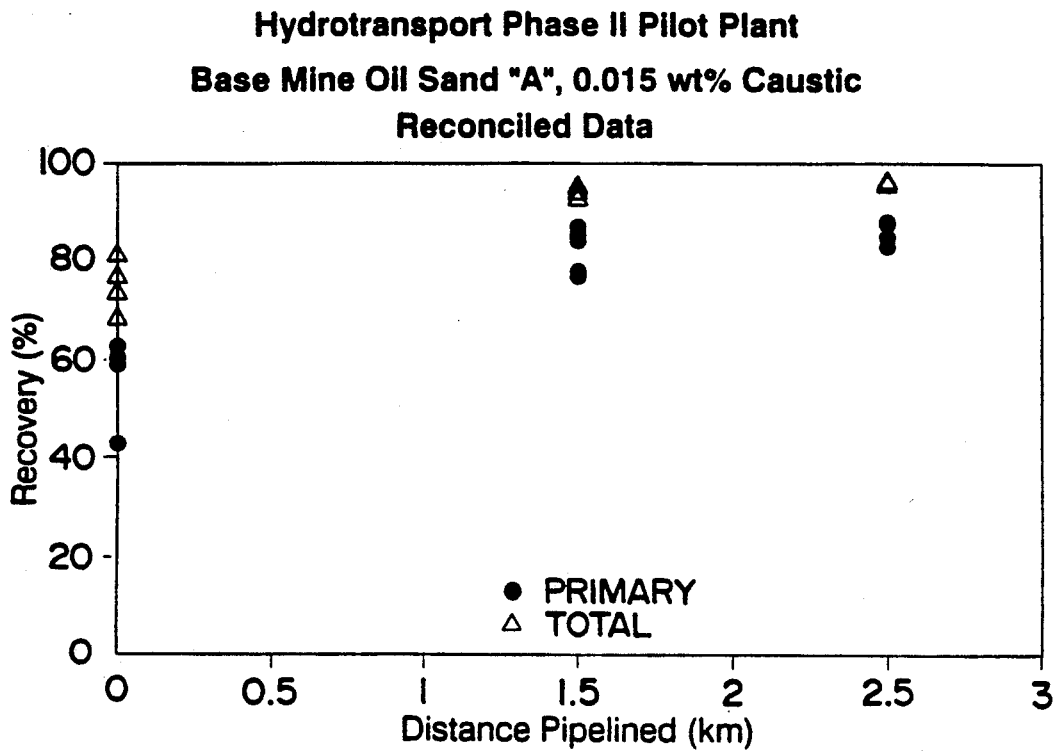
Figure 16:
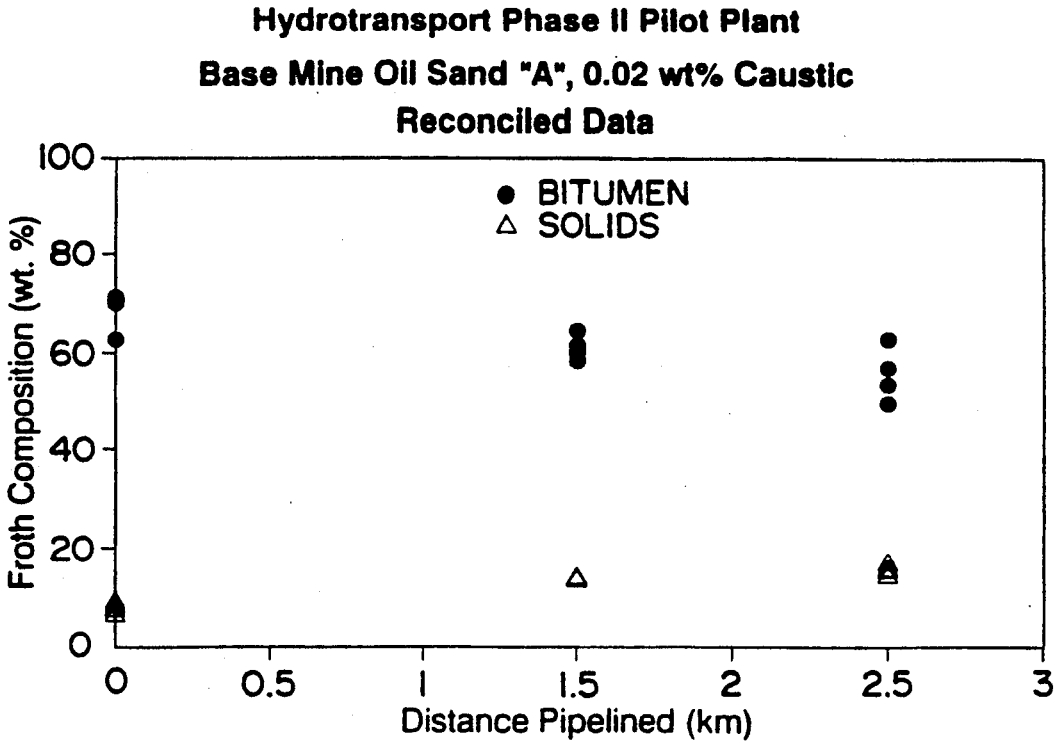
FIG. 16 is a plot of froth composition versus distance pipelined for the Base Mine "A" oil sand.

The last oil sand processed was from the Base Mine. This was a higher grade oil sand with bitumen content of 11.3 wt. % and fines content of 28.9%. As shown in FIG. 15, at 0 km the slurry produced an average primary recovery of 56% and an average total recovery of 75%. After 1.5 km of pipeline travel, the bitumen primary and total recoveries increased significantly. Increasing the travel by an additional 1 km produced only a slight increase in recoveries. As shown in FIG. 16, the solids content in the primary froth increased with pipeline travel time.

In summary, the pilot test showed that the residence time in 2.5 km of 4 inch pipeline was enough to provide sufficient conditioning for the oil sands tested. In general, bitumen recovery improved with distance pipelined, although it tended to level off as conditioning was complete. Over-conditioning did not occur.

The scope of the invention is set forth in the claims now following.

The embodiments of the invention in which an exclusive property or privilege is claimed are defined as follows:

1. A process for simultaneously transporting and conditioning naturally water-wet oil sand to enable recovery of bitumen in a conventional gravity separation vessel, comprising:

surface mining oil sand at a mine site;

removing oversize from the oil sand so that it can be pumped through a pipeline;

mixing the oil sand, at the mine site, with hot water and, optionally, process aid if required, and entraining air in the fluid during mixing, to form an aerated slurry;

pumping the slurry through a pipeline from the mine site to a bitumen extraction plant, said pipeline being of sufficient length so that separation of bitumen from sand and subsequent aeration of bitumen both occur, to render the aerated bitumen buoyant; and introducing the slurry from the pipeline directly into a gravity separation vessel and processing it therein by gravity separation under quiescent conditions to recover bitumen in the form of froth.

2. The process as set forth in claim 1 wherein:

the pipeline is at least 2.5 kilometers in length.

3. The process as set forth in claim 2 wherein:

mixing is conducted so as to form a slurry containing, by weight, about 50 to 70% oil sand, about 50 to 30% water and less than about 0.05% alkaline process aid, said water being supplied at a temperature sufficient to yield a slurry having a temperature in the range of about 40°-70° C.

4. The process as set forth in claim 3 wherein:

the slurry from the pipeline is processed in a separation circuit to recover by flotation at least 90% of the bitumen, contained in the oil sand feed, in the form of froth.

5. The process of claim 1 wherein the entraining of air in the fluid during mixing comprises mixing the mixture of oil sand, water and, optionally, process aid in a chamber open to the atmosphere under conditions sufficient to create a vortex in said mixture, thereby passively entraining the air into the mixture.

6. A process for simultaneously transporting and conditioning naturally water-wet oil sand to enable recovery of bitumen in a gravity separation vessel, comprising:

surface mining oil sand at a mine site;

screening oversize from the oil sand so that it can be pumped through a pipeline;

mixing the oil sand, at the mine site, with hot water and, optionally, process aid and entraining air in the fluid during mixing, to form an aerated slurry;

pumping the slurry through a first section of pipeline a sufficient distance so that separation of bitumen from sand and subsequent aeration of bitumen both occur, to render the aerated bitumen buoyant;

separating substantially all of the coarse solids from the slurry;

pumping the remaining slurry through a second section of pipeline extending to a bitumen extraction plant; and introducing the slurry from the pipeline directly into a gravity separation vessel and processing it therein by gravity separation under quiescent conditions to recover bitumen in the form of froth.

7. The process as set forth in claim 6 wherein:

mixing is conducted so as to form a slurry containing, by weight, about 50 to 70% oil sand, about 50 to 30% water and less than about 0.05% alkaline process aid, said water being supplied at a temperature sufficient to yield a slurry having a temperature in the range of about 40°-70° C.

8. The process as set forth in claim 7 wherein:

the slurry from the pipeline is processed in a separation circuit to recover by flotation at least 90% of the bitumen, contained in the oil sand feed, in the form of froth.

9. The process of claim 6 wherein the entraining of air in the fluid during mixing comprises mixing the mixture oil sand, water and, optionally, process aid in a chamber open to the atmosphere under conditions sufficient to create a vortex in said mixture, thereby passively entraining the air into the mixture.

* * * * *